US011021910B2

(12) United States Patent
Turner et al.

(10) Patent No.: US 11,021,910 B2
(45) Date of Patent: Jun. 1, 2021

(54) SEALING ASSEMBLY AND RELATED METHODS

(71) Applicant: APS Technology, Inc., Wallingford, CT (US)

(72) Inventors: William Evans Turner, Wallingford, CT (US); Serhiy Korostensky, Fairfield, CT (US)

(73) Assignee: APS Technology, Inc., Wallingford, CT (US)

( * ) Notice: Subject to any disclaimer, the term of this patent is extended or adjusted under 35 U.S.C. 154(b) by 43 days.

(21) Appl. No.: 16/588,200

(22) Filed: Sep. 30, 2019

(65) Prior Publication Data

US 2021/0095527 A1 Apr. 1, 2021

(51) Int. Cl.
*E21B 4/00* (2006.01)
*E21B 12/00* (2006.01)

(52) U.S. Cl.
CPC ..... *E21B 4/003* (2013.01); *E21B 12/00* (2013.01); *E21B 4/00* (2013.01); *E21B 2200/01* (2020.05)

(58) Field of Classification Search
CPC ..... E21B 4/003; E21B 2200/01
See application file for complete search history.

(56) References Cited

U.S. PATENT DOCUMENTS 5,628,516 A * 5/1997 Grenke ..... E21B 33/085 277/300
8,870,187 B2 * 10/2014 Murray ..... E21B 4/003 277/342
2014/0060805 A1 * 3/2014 Campbell ..... E21B 33/03 166/75.11
2017/0037848 A1 * 2/2017 Robison ..... E21B 43/126

* cited by examiner

*Primary Examiner* — Tara Schimpf
(74) *Attorney, Agent, or Firm* — Offit Kurman, P.A.; Gregory A. Grissett

(57) ABSTRACT

A sealing assembly having a housing having a main cavity, a sealing unit configured to receive a rotatable shaft, and at least a first sealing element, and a second sealing element positioned uphole with respect to the first sealing element along the longitudinal axis. The sealing assembly includes a first valve carried by the housing and coupled to the first sealing element and the main cavity, and configured to open at a first pressure level. The sealing assembly further includes a second valve coupled to the second sealing element and the main cavity, and configured to open at a second pressure level higher than the first pressure level. The sealing assembly is configured such that pressure is distributed across the first and second sealing elements sequentially.

31 Claims, 6 Drawing Sheets

SEALING ASSEMBLY AND RELATED METHODS

TECHNICAL FIELD

The present disclosure relates to an assembly and method for pressure control across a sealing system.

BACKGROUND

Underground drilling, such as gas, oil, or geothermal drilling, generally involves drilling a bore through a formation deep in the earth. Such bores are formed by connecting a drill bit to long sections of pipe, referred to as a "drill pipe," to form an assembly commonly referred to as a "drill string." Rotation of the drill bit advances the drill string into the earth, thereby forming the bore. Directional drilling refers to drilling systems configured to allow the drilling operator to direct the drill bit in a particular direction to reach a desired target hydrocarbon that is located some distance vertically below the surface location of the drill rig and is also offset some distance horizontally from the surface location of the drill rig. Steerable systems use bent tools located downhole for directional drilling and are designed to direct the drill bit in the direction of the bend. Rotary steerable systems use moveable blades, or arms, that can be directed against the borehole wall as the drill string rotates to cause directional change of the drill bit. Finally, rotary steerable motor systems also use moveable blades that can be directed against the borehole wall to guide the drill bit. Directional drilling systems have been used to allow drilling operators to access hydrocarbons that were previously unaccessible using conventional drilling techniques.

In order to lubricate the drill bit and flush cuttings from its path, a fluid, referred to as "drilling mud," is directed through an internal passage in the drill string and out through the drill bit. The drilling mud then flows to the surface through the annular passage formed between the drill string and the surface of the bore. Since the drilling mud must be highly pressurized, the drill string is subjected to a large pressure gradient in the radial direction, as well as high axial and torque loading due to the forces associated with rotating and advancing the drill bit and carrying the weight of the drill string.

Sealing is used to keep lubricated fluids in, while preventing the addition of contaminants, such as mud and water. Sealing around rotating shafts is performed in numerous ways. Sealing moving shafts is difficult in high pressure, dynamic operations, such as at high differential pressures and relatively high shaft rotational speeds typical in drilling operations. In general, the contact stress between the seal and shaft increases with increasing differential pressure. As the pressure differential across the seal increases, the differential pressure acts on the unsupported area of the sealing element to create a high force, especially a high radial force, on the stationary sealing element acting against the rotating shaft. At some point, the seal can deform, extrude, or heat up to the point of leakage or failure.

SUMMARY

There is a need to provide better pressure control for a sealing system that limits the pressure differential across a sealing element. An embodiment of the present disclosure is a sealing assembly. The sealing assembly includes a housing having an outer surface, an inner surface, a main cavity defined by the inner surface, a first end and a second end spaced from the first end along a central longitudinal axis. The sealing assembly further includes a sealing unit mounted to the inner surface. The sealing unit includes an internal passage configured to receive a rotatable shaft, a first sealing element, and a second sealing element positioned uphole with respect to the first sealing element along the central longitudinal axis. The sealing assembly further includes a first valve carried by the housing and hydraulically coupled to the first sealing element and the main cavity. The first valve is configured to open at a first pressure level. The sealing assembly further includes a second valve carried by the housing and hydraulically coupled to the second sealing element and the main cavity. The second valve is configured to open at a second pressure level that is higher than the first pressure level. The sealing assembly is configured such that when the pressure exceeds the first pressure level and the second pressure level, the first relief valve and the second relief valve open sequentially so as to distribute pressure across the first sealing element and the second sealing element sequentially.

Another embodiment of the present disclosure is a sealing assembly configured for a pressurized sealing environment. The sealing assembly includes a housing having an outer surface, an inner surface, a main cavity defined by the inner surface, a first end and a second end spaced from the first end along a central longitudinal axis. The sealing assembly further includes a sealing unit mounted to the inner surface. The sealing unit includes an internal passage configured to receive a rotatable shaft, and at least two sealing elements positioned along the central longitudinal axis and in contact with the rotatable shaft. The sealing assembly further includes at least two valves carried by the housing and hydraulically coupled to the at least two sealing elements and the main cavity. The at least two valves are configured to transition from a closed configuration into an open configuration when the pressure exceeds different respective pressure levels. The sealing assembly is configured such that as the pressure exceeds the two different respective pressure levels and the at least two relief valves transition from a closed configuration into an open configuration, the pressure is distributed across the at least two sealing elements sequentially.

A further embodiment of the present disclosure is a method that includes causing drilling fluid to flow through an internal passage of a drill string carrying a tool assembly having a sealing unit comprising a first sealing element and a second sealing element each in contact with the shaft. The method further includes causing a shaft to rotate within the tool assembly, wherein the first and second sealing elements are in contact with the shaft. The method further includes opening a first valve of the tool assembly corresponding to the first sealing element when a pressure exceeds a first pressure level so as to distribute pressure across the first sealing element. The method further includes opening a second valve corresponding to the second sealing element when the pressure exceeds a second pressure level that is higher than the first pressure level, such that, the pressure is distributed is across the first sealing element and the second sealing element.

Another embodiment of the present disclosure is a sealing assembly. The sealing assembly includes a housing having an outer surface, an inner surface, a main cavity defined by the inner surface, a first end and a second end spaced from the first end along a central longitudinal axis. The sealing assembly further includes a sealing unit mounted to the inner surface. The sealing unit includes an internal passage configured to receive a rotatable shaft, a first sealing element, a second sealing element positioned uphole with respect to the first sealing element along the central longitudinal axis, a third sealing element positioned uphole with respect to the first sealing element and the second sealing element along the central longitudinal axis, and a fourth sealing element positioned uphole with respect to the first sealing element, the second sealing element, and the third sealing element along the longitudinal axis. The sealing assembly further includes a first valve carried by the housing and hydraulically coupled to the first sealing element and the main cavity. The first valve is configured to open at a first pressure level. The sealing assembly further includes a second valve carried by the housing and hydraulically coupled to the second sealing element and the main cavity. The second valve is configured to open at a second pressure level that is higher than the first pressure level. The sealing assembly further includes a third valve carried by the housing and hydraulically coupled to the third sealing element and the main cavity. The third valve is configured to open at a third pressure level that is higher than the first pressure level and the second pressure level. The sealing assembly further includes a fourth valve carried by the housing and hydraulically coupled to the fourth sealing element and the main cavity. The fourth valve is configured to open at a fourth pressure level that is higher than the first pressure level, the second pressure level, and the third pressure level. The sealing assembly further includes a compensation piston disposed in the main cavity. The compensation piston is movable relative to the sealing unit in response to an increase in pressure, wherein when the pressure exceeds the first pressure level, the second pressure level, the third pressure level, and the fourth pressure level, the first valve, the second valve, the third valve, and the fourth valve open sequentially so as to distribute pressure across the first sealing element, the second sealing element, the third sealing element, and the fourth sealing element sequentially.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
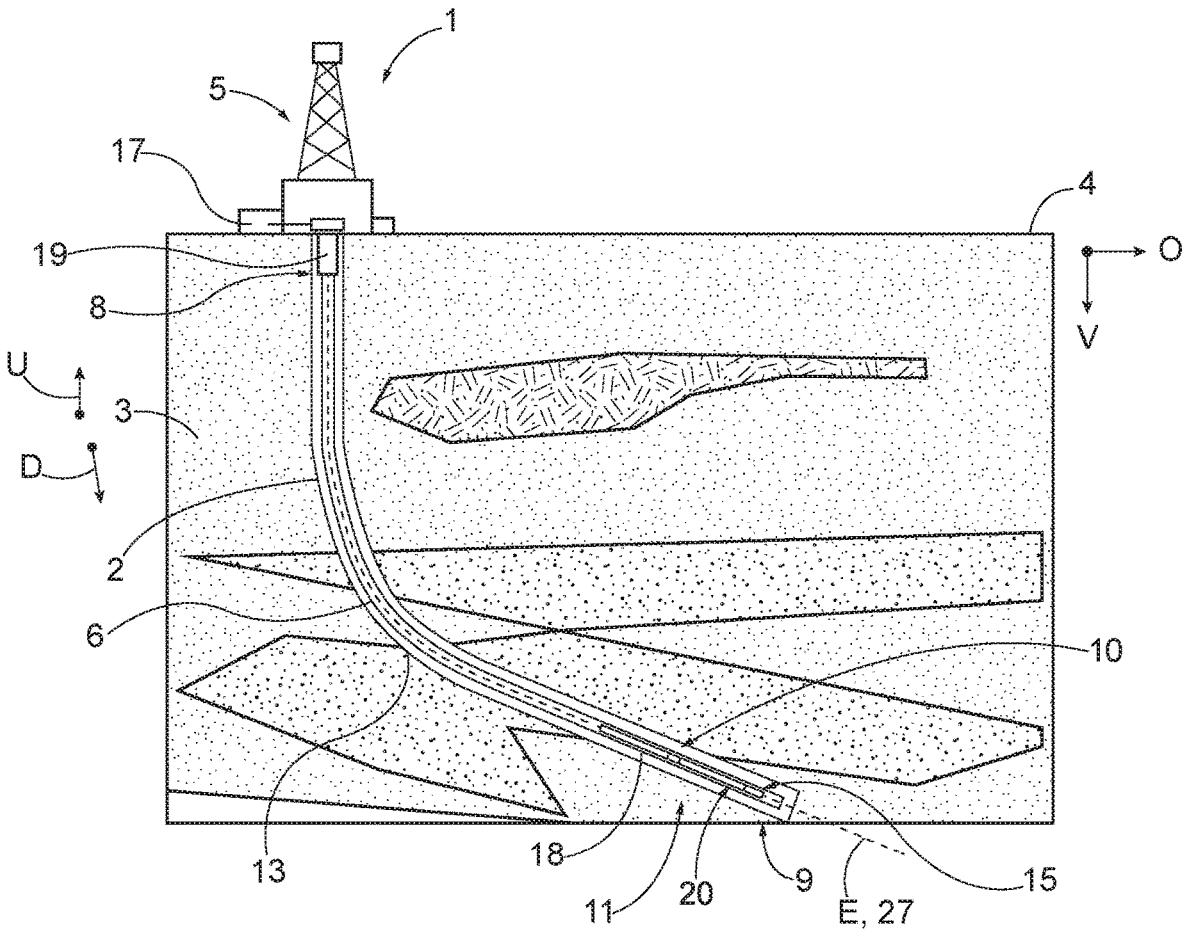
FIG. 1 is a schematic side view of a drilling system according to an embodiment of the present disclosure.
Figure 2:
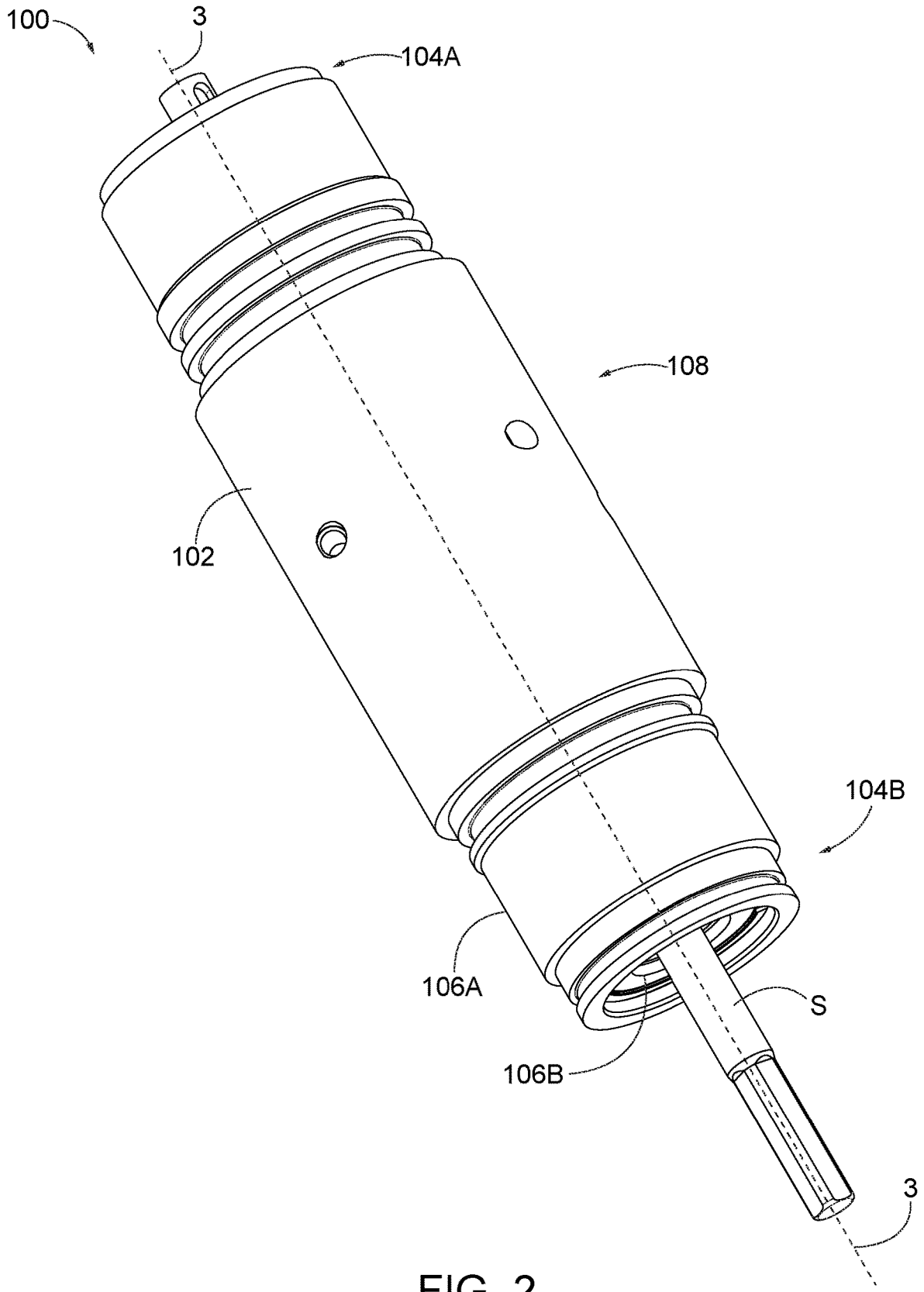
FIG. 2 is a perspective view of a tool assembly according to an embodiment of the present disclosure.

As shown in FIGS. 1 and 2, embodiments of the present disclosure include a pressure control tool assembly 100 configured for use in a downhole drilling environment in a drilling system 1. The pressure control tool assembly 100 is used to reduce the differential pressure across sealing elements of a rotating shaft used in a downhole tool assembly of the drilling system 1. "Tool assembly" and "sealing assembly" may be used interchangeably in the present disclosure.

Referring to FIG. 1, the drilling system 1 includes a rig or derrick 5 that supports a drill string 6. The drill string 6 is elongate along a longitudinal central axis 27 that is aligned with a well axis E. The drill string 6 further includes a first end 8 and a second end 9 spaced from the first end 8 along the longitudinal central axis 27. A downhole or downstream direction D refers to a direction from the surface 4 toward the second end 9 of the drill string 6. An uphole or upstream direction U is opposite to the downhole direction D. Thus, "downhole" and "downstream" refers to a location that is closer to the drill string second end 9 than the surface 4, relative to a point of reference. "Uphole" and "upstream" refers to a location that is closer to the surface 4 than the drill string downstream end 9, relative to a point of reference.

Continuing with FIG. 1, the drill string 6 includes a bottom hole assembly (BHA) 10 coupled to a drill bit 15. The drill bit 15 is configured to drill a borehole or well 2 into the earthen formation 3 along a vertical direction V and an offset direction θ that is offset from or deviated from the vertical direction V. The drilling system 1 can include a surface motor (not depicted) located at the surface 4 that applies torque to the drill string 6 via a rotary table or top drive (not depicted), and a downhole motor 18 disposed along the drill string 6 that is operably coupled to the drill bit 15 for powering the drill bit 15. Operation of the downhole motor 18 causes the drill bit 15 to rotate along with or without rotation of the drill string 6. In this manner, the drilling system 1 is configured to operate in a rotary drilling mode, where the drill string 6 and the drill bit 15 rotate, or a sliding mode where the drill string 6 does not rotate but the drill bit does rotate. Accordingly, both the surface motor and the downhole motor 18 can operate during the drilling operation to define the well 2. The drilling system 1 can also include a casing 19 that extends from the surface 4 and into the well 2. The casing 19 can be used to stabilize the formation near the surface. One or more blowout preventers can be disposed at the surface 4 at or near the casing 19. During the drilling operation, in a drilling operation, the drill bit 15 drills a borehole into the earthen formation 3. A pump 17 pumps drilling fluid downhole through an internal passage (not depicted) of the drill string 6 out of the drill bit 15. The drilling fluid then flows upward to the surface through the annular passage 13 between the bore hole and the drill string 6, where, after cleaning, it is recirculated back down the drill string 6 by the mud pump.

Figure 3:
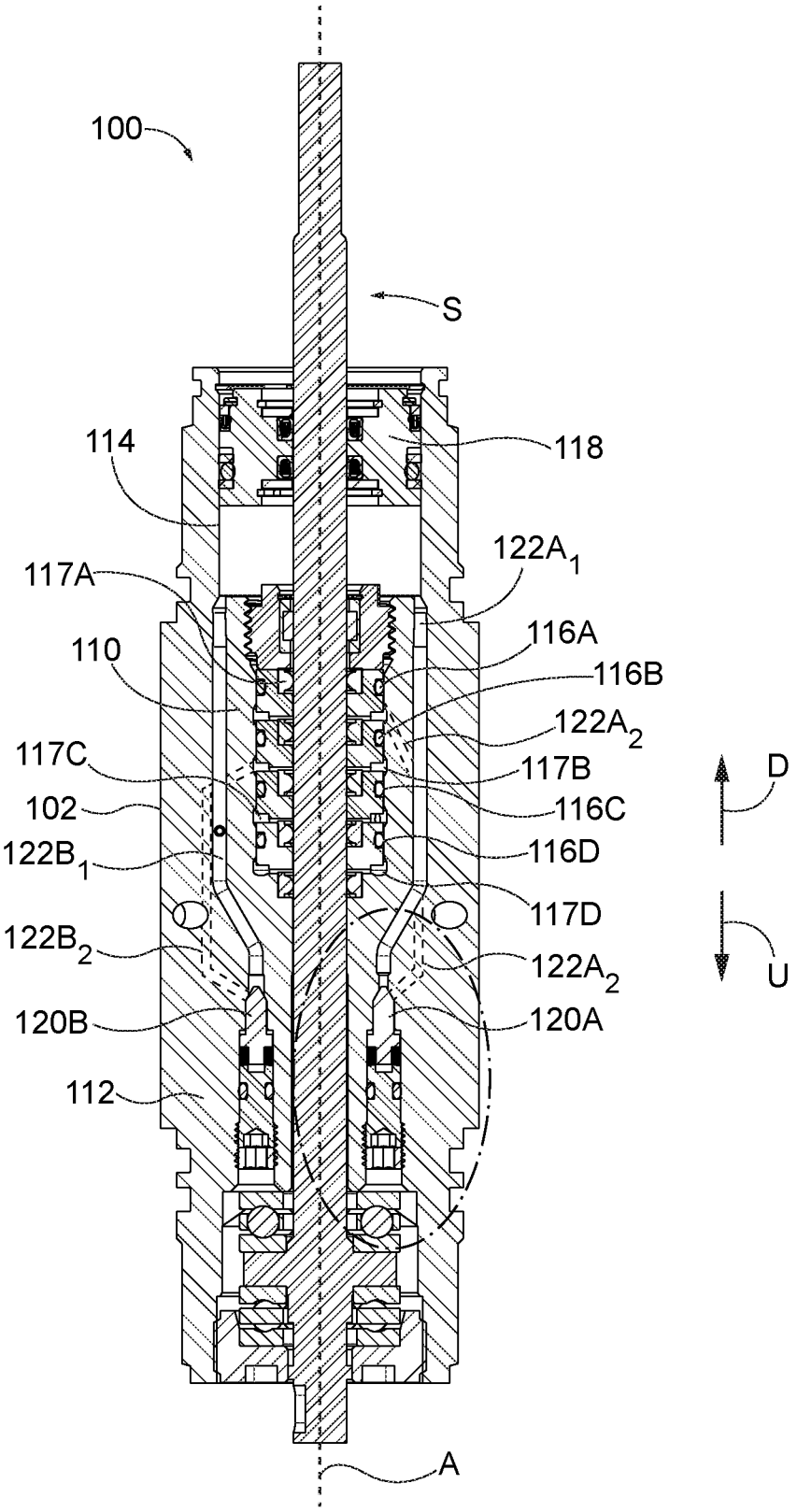
FIG. 3 is a cross-sectional view of the tool assembly shown in FIG. 2 taken along line 3-3.

Referring to FIGS. 2 and 3, an exemplary downhole tool assembly 100 for pressure control includes a housing 102, a sealing unit 110, a valve assembly 112, and a compensation piston 118 located inside of the housing 102. The tool assembly 100 is elongated along a central axis A and has a first end 104A and a second end 104B opposite the first end 104A along the central axis. The housing 102 has a body 108 that defines an outer surface 106A, an inner surface 106B, and an internal passage (not numbered) that extends from the first end 104A to the second end 104B along the inner surface 106B. The internal passage is sized to permit a rotatable shaft S to pass therethrough. The body 108 has a length that extends from the first end 104A to the second end 104B along the central axis A. In the present disclosure, the length of the body 108 is approximately six inches. In alternative embodiments, the length of the body 108 may vary.

Referring to FIG. 3, the housing 102 carries the sealing unit 110 and the valve assembly 112. The housing 102 includes a main cavity 114 defined by the inner surface 106B. In the illustrated embodiment, the main cavity 114 is located at the second end 104B of the tool assembly 100. The main cavity 114 is located downhole of the valve assembly 112 and the sealing unit 110. In alternative embodiments, the components of the downhole tool assembly 100 may be flipped such that the main cavity 114 is located uphole of the valve assembly 112 and the sealing unit 110. The main cavity 114 includes an uphole portion 115A and a downhole portion 115B opposite the uphole portion 115A. The main cavity 114 is open to an internal passage defined by the body of the housing. The internal passage receives therethrough the rotatable shaft S. The main cavity 114 carries the compensation piston 118. The main cavity 114 is sized and shape to slidingly mate with an outer surface of the compensation piston 118. However, the main cavity 114 is also sized to permit the compensation piston 118 to move along the central axis A in response to pressure changes in the downhole environment. The compensation piston 118 is configured to move towards the sealing unit 110 to the first end 115A of the main cavity 114 as pressure increases.

The sealing unit 110 is also configured to slidingly receive the rotating shaft S. As shown, the sealing unit 110 may be mounted to the inner surface 106B, yet is located downhole with respect to the valve assembly 112. The sealing unit 110 may include one or more separate sealing elements 116 supported by one or more carriers 117A-117D. In the illustrated embodiment, the sealing unit 110 includes four sealing elements 116A, 116B, 116C, and 116D and four respective carriers 117A, 117B, 117C, and 117D, respectively. In the present disclosure, the reference number 116 and 116A though 116D are used interchangeably to refer to similar configured sealing elements. As shown, the sealing unit 110 includes a first sealing element 116A and a second sealing element 116B located uphole relative to the first sealing element 116A. The sealing unit 110 further includes a third sealing element 116C located uphole relative to the first sealing element 116A and the second sealing element 116B. The sealing unit 110 also includes a fourth sealing element 116D located uphole relative to the first sealing element 116A, the second sealing element 116B, and the third sealing element 116C. The sealing elements 116A-116D are lined up next to each other. An internal passage (not numbered) extends through each sealing element and is configured to receive the rotatable shaft S. In the illustrated embodiment, the sealing unit 110 includes four sealing elements. However, the sealing unit 110 may include more than four sealing elements, or less than four sealing elements may be used. For example, each sealing unit may include a first sealing element 116A and a second sealing element 116B.

Each sealing element 116A-116D is defined by a seal that is in sealing contact with the rotatable shaft S. The sealing elements 116A-116D are configured to compress against the inner surface 106B of the pressure control tool assembly 100, forming a seal against the inner surface 106B. The seal divides a high pressure side located downhole relative to the sealing elements 116A-116D and a lower pressure side located uphole relative to the sealing elements 116A-116D. In this regard, the sealing elements 116A-116D function as differential pressure sealing elements. Each sealing element 116A-116D can define a ring shape that seats into respective annular grooves defined by the housing 102 (not depicted). In the illustrative embodiment, the sealing elements 116A-116D are annular rings that form a seal with the rotating shaft S. In one example, the sealing elements 116A-116D are T-seals. In another example, the sealing elements 116A-116D are O-rings. In yet another example, the sealing elements 116A-116D are quad seals. In another example, the sealing elements 116A-116D are packing material. In yet another example, the sealing elements 116A-116D may be comprised of metal and polished to form a seal with the rotating shaft S. Each of the sealing elements 116A-116D are held by a respective carrier 117A-117D.

The valve assembly 112 is configured to help distribute pressure across the different sealing elements. As shown, the valve assembly is located uphole relative to the main cavity 114 and the sealing unit 110. The valve assembly 112 may include at least two separate valves. In the illustrated embodiment, the valve assembly 112 includes four valves: a first valve 120A, a second valve 120B, a third valve 120C (not depicted), and a fourth valve 120D (not depicted). The number of valves generally correspond to the number of sealing elements. For clarity in illustration and description, only the first valve 120A and the second valve 120B are illustrated in the figures. Each of the valves 120A-120D are positioned such that the valves 120A-120D generally surround the central axis A of the tool assembly 100. The valves 120A-120D are configured to open as pressure increases inside the pressure control tool assembly 100. Each valve 120A-120D can be rated to transition from a closed configuration into an open configuration at a predetermined pressure level. In one example, the predetermined pressure level can be about 3000 psi. In such an example, with four valves as described, a total pressure of 12,000 psi can be distributed across four sealing elements. The sequential distribution of pressure along pressure increases reduces contact stresses and the likelihood of heel extrusion of sealing elements and wear.

The first valve 120A includes a first input passageway 122Ai that is hydraulically coupled to the main cavity 114. In particular, the first input passageway 122Ai extends from the first valve 120A to the main cavity 114 through the housing body 108. The first valve 120A further includes a first output passageway 122A2 that is hydraulically coupled to the first sealing element 116A of the sealing unit 110. Similarly, the second valve 120B includes a second input passageway 122Bi hydraulically coupled to the main cavity 114, and a second output passageway 122B2 hydraulically coupled to the second sealing element 116B of the sealing unit 110. The first output passageway 122A2 extends from the first valve 120A to a location between the first sealing element 116A and the second sealing element 116B. The second input passageway 122Bi extends from the second valve 120B to the main cavity 114. The second output passageway 122B2 extends from the second valve 120B to a location between the second sealing element 116B and the third sealing element 116C. As can be seen in the drawings, each input and output passageway described above does not define a linear path through the housing body 108. More specifically, each passageway has one or more deviations to direct fluid from the valve to its outlet point. As used herein, a deviation may be a curve or bend in the passageway.

In the illustrative embodiment, the third valve 120C and the fourth valve 120D each include an input passageway (not depicted) coupled to the main cavity 114, and an output passageway (not depicted) coupled to the third sealing element 116C and the fourth sealing element 116D of the sealing unit 110, respectively. The third input passageway extends from the third valve 120C to the main cavity 114. The third output passageway extends from the third valve 120C to a location between the third sealing element 116C and the fourth sealing element 116D. The fourth input passageway extends from the fourth valve 120D to the main cavity 114. The fourth output passageway extends from the fourth valve 120D to a location between the fourth sealing element 116D and the end of the sealing unit 110. As described above, each input and output passageway for the third and fourth valves do not define a linear path through the housing body. More specifically, each passageway has one or more deviations to direct fluid from the valve to its outlet point. As used herein, a deviation may be a curve or bend in the passageway.

Figure 4:
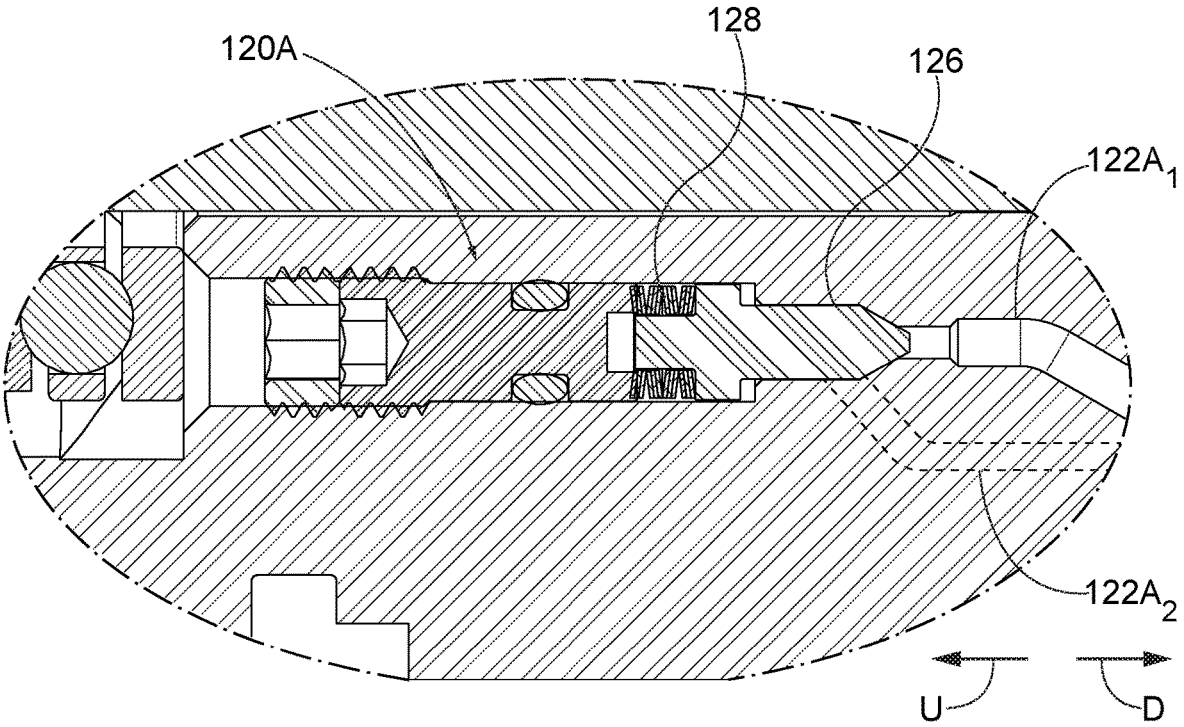
FIG. 4 is a detailed cross-sectional view of a portion of the tool assembly shown in FIG. 3.

FIG. 4 is a side view of a cross section of the first valve 120A of valve assembly 114 in FIG. 3. The first valve 120A includes a plug 126 and springs 128. The first valve 120A is configured to carry lubricant. In one example, the lubricant is a de-aired oil that fills the cavities and passageways of the valve assembly. In the illustrated embodiment, the plug 126 is made of metal. In an alternative embodiment, the plug 126 may be a diaphragm plug. In the illustrated embodiment, the springs 128 may be Belleville springs. In alternative embodiments, the springs 128 may be any type of spring known in the art. The springs 128 are configured to deform as pressure increases inside the pressure control tool assembly 100, via the first input passageway 122Ai. When the springs 128 deform, the first valve is pushed open, directing the pressure out via the output passageway 122A2 and across the first sealing element 116A.

The valves 120A-120D are configured to transition from a closed configuration into an open configuration when the pressure exceeds a predetermined pressure level. The open configuration is when the pressure in the input passageway exceeds the predetermined pressure level, causing the plug 126 to compress the spring and separate from the valve wall to allow fluid to enter the output passageway. In this manner, fluid can be directed toward the sealing element and pressure is therefore distributed across that sealing element. As pressure increases, the second valve 120B transitions into the open configuration when pressure exceeds a predetermined level. This continues until each valve transitions from the closed configuration into the open configuration. In one example, the predetermined pressure level for each valve can be about 3000 psi. In such an example, with four valves as described, a total pressure or 12,000 is psi can be distributed across four sealing elements. The sequential distribution of pressure along with increase in pressure reduces contact stresses and the likelihood of heel extrusion of the sealing elements.

Figure 5:
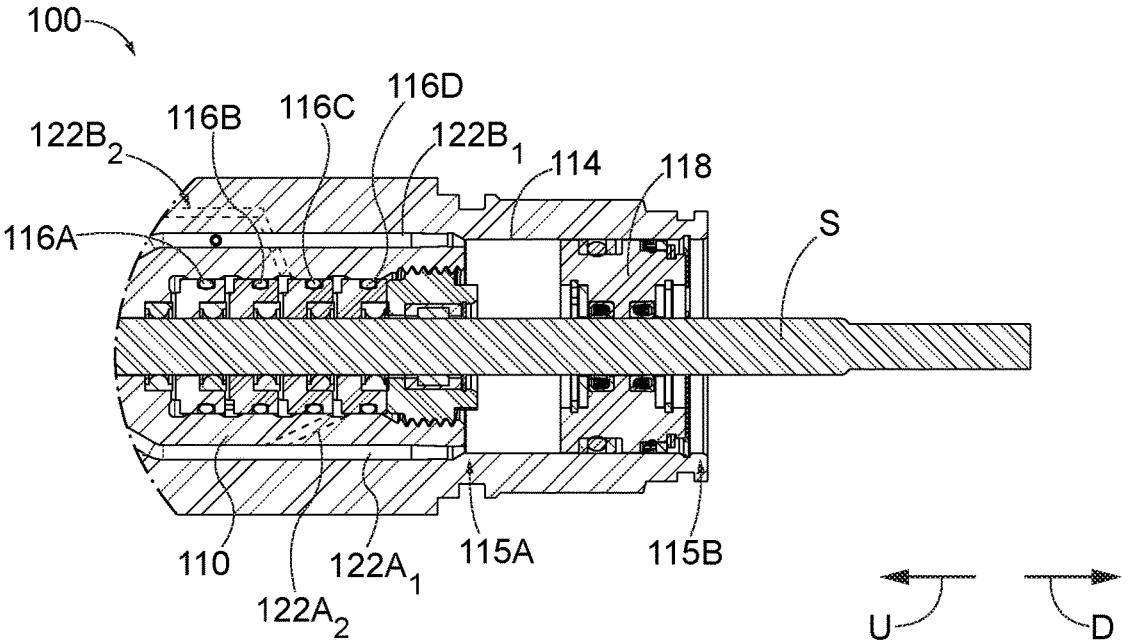
FIG. 5 is another detailed cross-sectional view of a portion of the tool assembly shown in FIG. 3.

Referring to FIG. 5, the main cavity 114 carries the compensation piston 118. The compensation piston 118 is configured to move in the main cavity 114 relative to the sealing unit 110 in response to an increase in pressure. In the illustrative embodiment, the compensation piston 118 is an annular piston. The compensation piston 118 may be shaft-guided by a journal bearing relationship with the shaft. This configuration may minimize the compression changes and the lateral sliding motion that the sealing elements 116A-116D experience due to lateral shaft movement. A clearance (not numbered) is provided between the compensation piston 118 and the housing 102, to accommodate lateral shaft misalignment and deflection without binding the compensation piston 118. The compensation piston 118 is configured to partition the lubricant from the drilling fluid environment, balance the lubricant pressure to the drilling fluid environment, and limit the deflection and stress of the rotatable shaft S.

Figure 6:
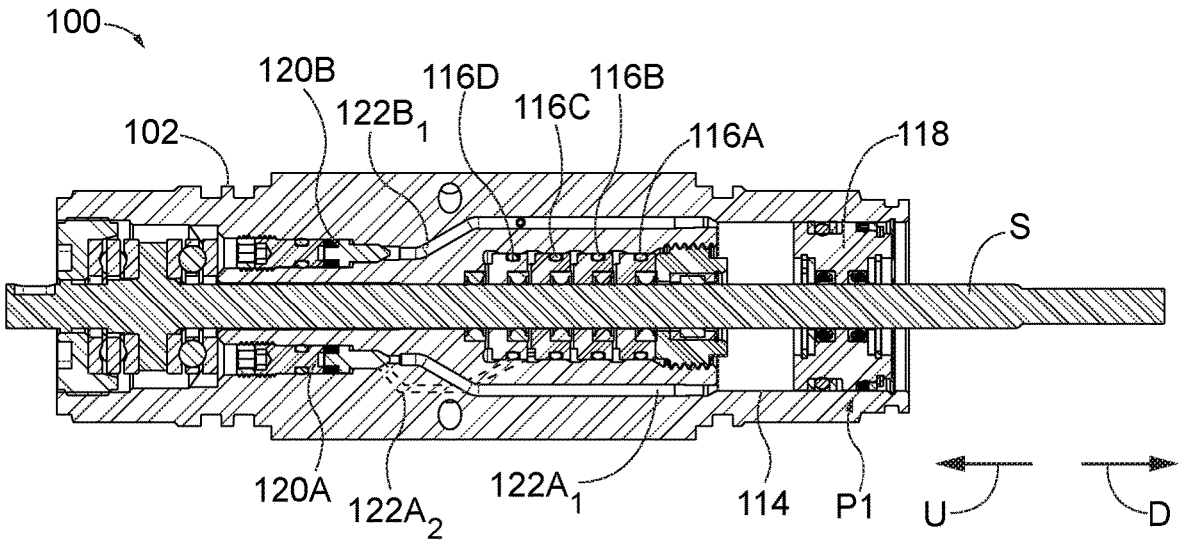
FIG. 6 is another cross-sectional view of the tool assembly taken along line 3-3 shown in FIG. 3, illustrating an initial position of a compensation piston.
Figure 7:
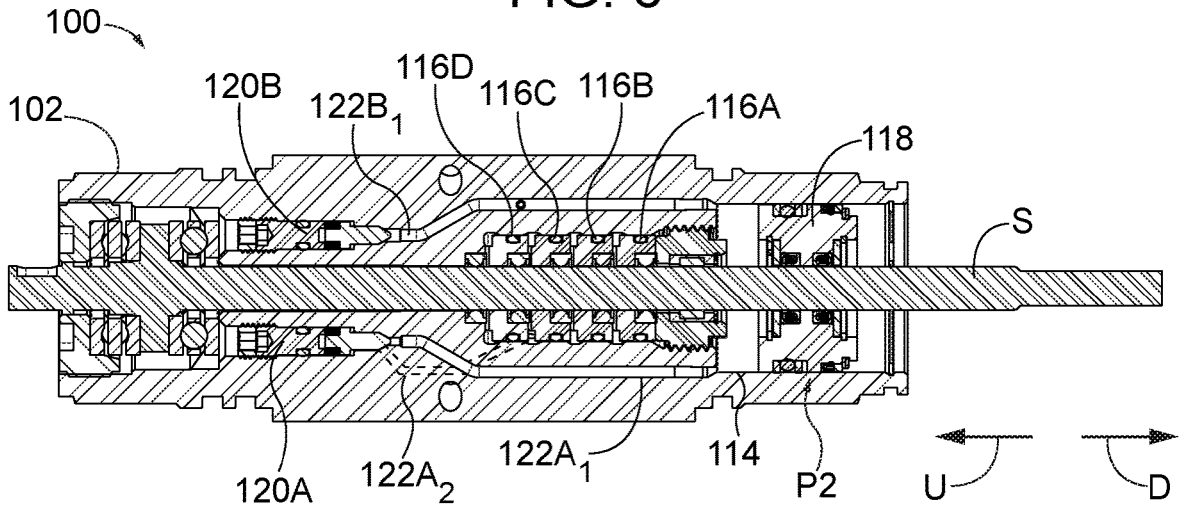
FIG. 7 is a cross-sectional view of the tool assembly shown in FIG. 6, illustrating the compensation piston in an intermediate position.
Figure 8:
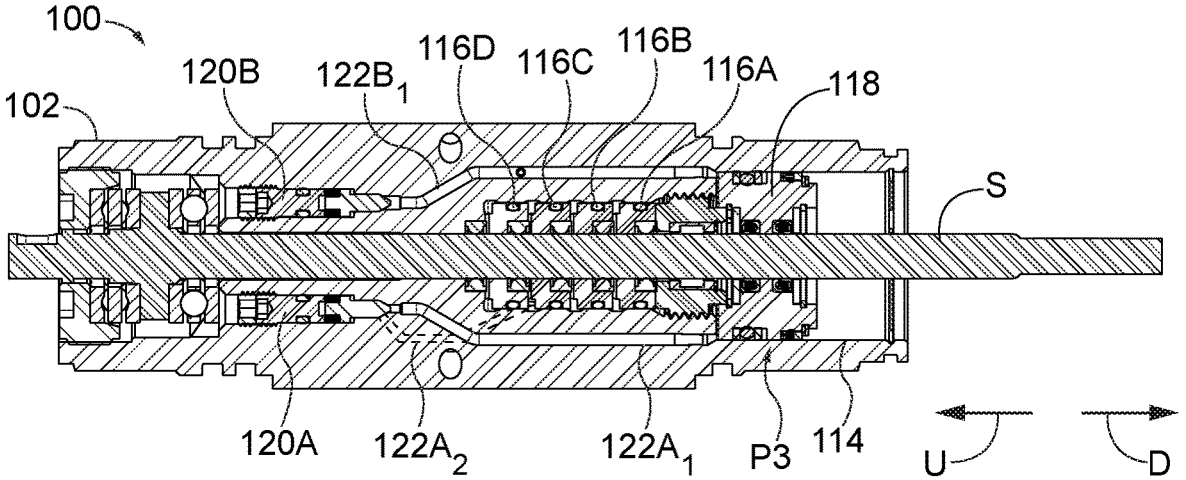
FIG. 8 is a cross-sectional view of the tool assembly shown in FIG. 7, illustrating the compensation piston in a terminal position.

FIGS. 6-8 illustrate the tool assembly 100 shown in FIG. 3, as the compensation piston 118 moves uphole toward the sealing unit 110 from an initial position to a terminal position. Referring to FIG. 6, when differential pressure is below a predetermined value or is at or near zero pressure differential, the compensation piston 118 is positioned at the second end of the main cavity 114 in a first or initial position P1. Upon application of pressure or an increase in pressure, as illustrated in FIG. 7, the compensation piston moves toward the sealing unit 110 into an intermediate position P2. When the pressure exceeds a first pressure level, the first valve 120A opens. The pressure is then distributed across the first sealing element 116A through the first output passageway 122A2 to a location between the first sealing element 116A and the second sealing element 116B. When the pressure continues to exceed a second pressure level, which is generally higher than the first pressure level, the second valve 120B opens. The pressure is then distributed across the second sealing element 116B through the second output passageway 122B2 to a location between the second sealing element 116A and the third sealing element 116B. This mechanism is repeated for the third valve 120C and fourth valve 120D as pressure increases past a third pressure level and a fourth pressure level. Accordingly, as pressure continues to increase, the piston 118 moves into a final or terminal position P3 in the main cavity 114, as shown in FIG. 8, causing the pressure to distribute across all the sealing elements 116A-116D as described above.

The practical result is that relatively equal pressure differentials across each of the sealing elements 116A-116D is obtained. For example, in an alternative embodiment where the pressure control tool assembly has five sealing elements, if a 15,000 psi pressure was applied to the pressure control tool assembly, then the mechanism described would provide a differential pressure of 3,000 psi across each of the five sealing elements. In the illustrated embodiment, the pressure levels which cause the valves to open vary depending on the application. For example, in an alternative embodiment where the pressure control tool assembly has 15 sealing elements, if a 15,000 psi pressure was applied, then the pressure level that each seal would withstand would be 1,000 psi. If pressure begins to decrease, the valves will close, and a higher level of pressure will be trapped within each sealing element. This pressure will remain in each sealing element but will likely decay with time as each sealing element repositions itself.

Figure 9:
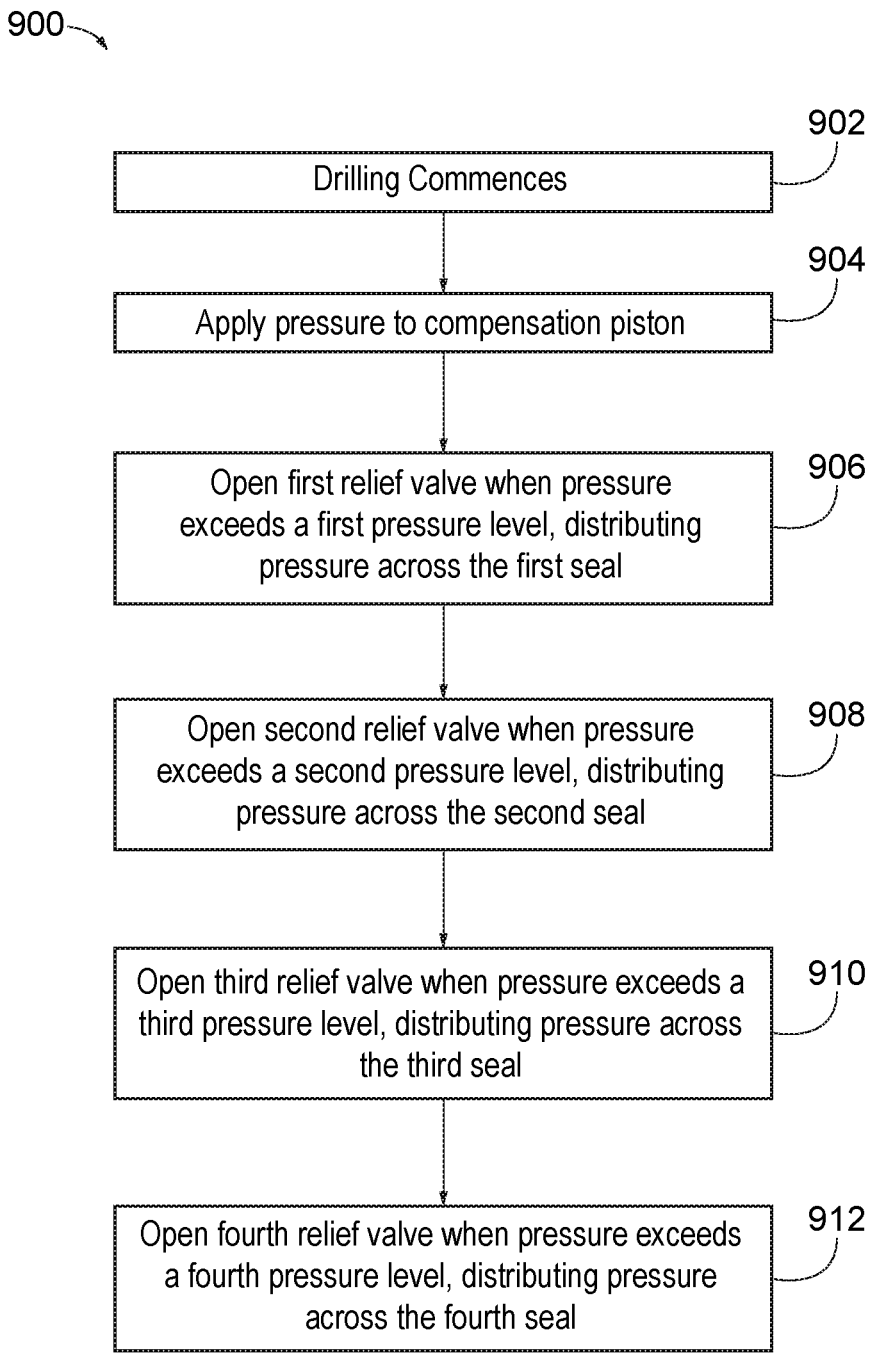
FIG. 9 is a process flow diagram illustrating a method for controlling pressure in the tool assembly shown in FIG. 3.

Now referring to FIG. 9, a method 900 for controlling pressure in the pressure control tool assembly 100 shown in FIG. 3, will be described. In step 902, the drilling commences. The drill string 6 is rotated by the drive system and drilling fluid is pumped through the drill string 6 and along the downhole tool assembly 100. In step 904, as the drill string progresses through the formation, pressure within the tool assembly 100 generally increases, applying pressure to the compensation piston 118 in the main cavity 114 of the housing 102 which, in turn, moves the compensation piston 118 from an initial position toward the sealing unit 114. In step 906, the first valve 120A transitions from a closed configuration into an open configuration when the pressure exceeds a first pressure level, distributing pressure across the first sealing element 116A via the first output passageway 122A2. In step 908, as the pressure continues to increase, the second valve 120B transition from the close configuration into the open configuration when the pressure exceeds a second pressure level, which is higher than the first pressure level. At this point, pressure is distributed across the second sealing element 116B via the second output passageway 122B2. In step 910, as the pressure continues to increase, the third valve 120C transitions from the closed configuration into the open configuration when the pressure exceeds a third pressure level. When the third valve is in the open configuration, pressure is distributed across the third sealing element via the third output passageway. Finally, in step 912, as pressure continues to increase, the fourth valve 120D transitions from the closed configuration into the open configuration when the pressure exceeds a fourth pressure level. When the fourth valve is in the open configuration, pressure is distributed across the fourth sealing element via the fourth output passageway.

Accordingly, the tool assembly configuration limits the pressure differential that occurs across any one sealing element by relieving some of the working pressure to a location between the respective sealing element and the adjacent downhole sealing element. As described above, each valve can be rated to open at the predetermined pressure level, e.g. 3000 psi. With four valves as described, a total pressure of 12,000 psi can be distributed across the four sealing elements, at a differential pressure of 3,000 psi per sealing element. The sequential distribution of pressure as the pressure increases reduces contact stresses and the likelihood of heel extrusion.

The present disclosure is described herein using a limited number of embodiments, these specific embodiments are not intended to limit the scope of the disclosure as otherwise described and claimed herein. Modification and variations from the described embodiments exist. For example, the terms "uphole" and "downhole" are only meant to describe the ends of the tool assembly. The tool assembly may be completely inverted. In addition, in alternative embodiments, the valves may be electrically or pneumatically controlled. Further, while embodiments of the present disclosure are shown and described with reference to oil and gas drilling systems, the sealing system and assembly as described herein may be used anywhere a high pressure seal is required, including environments involving a rotating shaft or a feature that compromises a standard static seals capability.

More specifically, the following examples are given as a specific illustration of embodiments of the claimed disclosure. It should be understood that the invention is not limited to the specific details set forth in the examples.

What is claimed:

1. A sealing assembly, comprising:

a housing having an outer surface, an inner surface, a main cavity defined by the inner surface, a first end and a second end spaced from the first end along a central longitudinal axis;

a sealing unit mounted to the inner surface, the sealing unit having a) an internal passage configured to receive a rotatable shaft, b) a first sealing element, and c) a second sealing element positioned uphole with respect to the first sealing element along the central longitudinal axis;

a first valve carried by the housing and hydraulically coupled to the first sealing element and the main cavity, the first valve being configured to open at a first pressure level;

a second valve carried by the housing and hydraulically coupled to the second sealing element and the main cavity, the second valve being configured to open at a second pressure level that is higher than the first pressure level; and wherein when the pressure exceeds the first pressure level and the second pressure level, the first valve and the second valve open sequentially so as to distribute pressure across the first sealing element and the second sealing element sequentially.

2. The sealing assembly of claim 1, further comprising a compensation piston disposed in the main cavity, the compensation piston being movable relative to the sealing unit in response to an increase in pressure.

3. The sealing assembly of claim 2, wherein the compensation piston is configured to move toward or away from the sealing unit in response to pressure applied to the compensation piston.

4. The sealing assembly of claim 1, further comprising a first carrier configured to hold the first sealing element.

5. The sealing assembly of claim 1, further comprising a second carrier configured to hold the second sealing element.

6. The sealing assembly of claim 1, further comprising:

a first input passageway extending from the first valve to the main cavity, and a first output passageway extending from the first valve to a location between the first sealing element and the second sealing element, wherein pressure is distributed across the first sealing element through the first output passageway to a location uphole from the first sealing element.

7. The sealing assembly of claim 1, further comprising:

a second input passageway extending from the second valve to the main cavity, and a second output passageway extending from the second valve to a location between the second sealing element and the first end of the housing, wherein pressure is distributed across the second sealing element through the second output passageway to a location uphole from the second sealing element.

8. The sealing assembly of claim 1, further comprising:

a third sealing element positioned uphole with respect to the first sealing element and the second sealing element along the longitudinal axis; and a fourth sealing element positioned uphole with respect to the first sealing element, the second sealing element, and the third sealing element along the longitudinal axis.

9. The sealing assembly of claim 8, further comprising a third carrier configured to hold the third sealing element, and a fourth carrier configured to hold the fourth sealing element.

10. The sealing assembly of claim 8, further comprising:

a third valve carried by the housing and hydraulically coupled to the third sealing element and the main cavity, the third valve being configured to open at a third pressure level that is higher than the first pressure level and the second pressure level; and a fourth valve carried by the housing and hydraulically coupled to the fourth sealing element and the main cavity, the fourth valve being configured to open at a fourth pressure level that is higher than the first pressure level, the second pressure level, and the third pressure level.

11. The sealing assembly of claim 10, further comprising:

a third input passageway extending from the third valve to the main cavity, and a third output passageway extending from the third valve to a location between the third sealing element and the first end of the housing, wherein pressure is distributed across the third sealing element through the third output passageway to a location uphole from the third sealing element.

12. The sealing assembly of claim 10, further comprising:

a fourth input passageway extending from the fourth valve to the main cavity, and a fourth output passageway extending from the fourth valve to a location between the fourth sealing element and the first end of the housing, wherein pressure is distributed across the fourth sealing element through the fourth output passageway to a location uphole from the fourth sealing element.

13. A sealing assembly configured for a pressurized sealing environment, the sealing assembly comprising:

a housing having an outer surface, an inner surface, a main cavity defined by the inner surface, a first end and a second end spaced from the first end along a longitudinal axis;

a sealing unit mounted to the inner surface, the sealing unit having a) an internal passage configured to receive a rotatable shaft, and b) at least two sealing elements positioned along the longitudinal axis and in contact with the rotatable shaft;

at least two valves carried by the housing and hydraulically coupled to the at least two sealing elements and the main cavity, the at least two valves being configured to transition from a closed configuration into an open configuration when the pressure exceeds different respective pressure levels; and wherein as pressure exceeds the two different respective pressure levels and the at least two valves transition from a closed configuration into an open configuration, the pressure is distributed across the at least two sealing elements sequentially.

14. The sealing assembly of claim 13, further comprising a compensation piston disposed in the main cavity, the compensation piston being movable relative to the sealing unit in response to an increase in pressure.

15. The sealing assembly of claim 14, wherein the compensation piston is configured to move toward or away from the sealing unit in response to pressure applied to the compensation piston.

16. The sealing assembly of claim 13, further comprising at least two carriers configured to hold the at least two sealing elements.

17. The sealing assembly of claim 13, further comprising:

at least two input passageways extending from each of the at least two valves to the main cavity, and at least two output passageways extending from each of the at least two valves to a location between the corresponding sealing elements; and wherein pressure is distributed across the at least two sealing elements through the at least two output passageways to a location uphole from the at least two sealing elements.

18. The sealing assembly of claim 17, wherein the at least two input passageways and the at least two output passageways include one or more deviations to direct fluid from each of the valves to an outlet.

19. A method, comprising:

causing drilling fluid to flow through an internal passage of a drill string carrying a tool assembly having a sealing unit comprising a first sealing element and a second sealing element each in contact with the shaft;

causing a shaft to rotate within the tool assembly, wherein the first and second sealing elements are in contact with the shaft;

opening a first valve of the tool assembly corresponding to the first sealing element when a pressure exceeds a first pressure level so as to distribute pressure across the first sealing element; and opening a second valve corresponding to the second sealing element when the pressure exceeds a second pressure level that is higher than the first pressure level, such that, the pressure is distributed is across the first sealing element and the second sealing element.

20. The method of claim 19, further comprising: applying pressure to a compensation piston disposed in a main cavity of a housing, thereby moving the compensation piston toward the sealing unit.

21. The method of claim 19, further comprising:

distributing the pressure across the first sealing element via a first output passageway that extends from the first sealing element to a main cavity of the tool assembly; and distributing the pressure across the first sealing element and the second sealing element via a second output passageway that extends from the second sealing element to the main cavity.

22. The method of claim 19, further comprising:

opening a third valve corresponding to a third sealing element of the sealing unit when the pressure exceeds a third pressure level that is higher than the second pressure level, such that the pressure is distributed is across the first sealing element, the second sealing element, and the third sealing element.

23. The method of claim 22, further comprising:

opening a fourth valve corresponding to a fourth sealing element of the sealing unit when the pressure exceeds a fourth pressure level that is higher than the third pressure level, such that the pressure is distributed is across the first sealing element, the second sealing element, the third sealing element, and the fourth sealing element.

24. The method of claim 19, further comprising drilling in a borehole of an earthen formation.

25. A sealing assembly, comprising:

a housing having an outer surface, an inner surface, a main cavity defined by the inner surface, a first end and a second end spaced from the first end along a central longitudinal axis;

a sealing unit mounted to the inner surface, the sealing unit having a) an internal passage configured to receive a rotatable shaft, b) a first sealing element, c) a second sealing element positioned uphole with respect to the first sealing element along the central longitudinal axis, d) a third sealing element positioned uphole with respect to the first sealing element and the second sealing element along the central longitudinal axis, and e) a fourth sealing element positioned uphole with respect to the first sealing element, the second sealing element, and the third sealing element along the central longitudinal axis;

a first valve carried by the housing and hydraulically coupled to the first sealing element and the main cavity, the first valve being configured to open at a first pressure level;

a second valve carried by the housing and hydraulically coupled to the second sealing element and the main cavity, the second valve being configured to open at a second pressure level that is higher than the first pressure level;

a third valve carried by the housing and hydraulically coupled to the third sealing element and the main cavity, the third valve being configured to open at a third pressure level that is higher than the first pressure level and the second pressure level;

a fourth valve carried by the housing and hydraulically coupled to the fourth sealing element and the main cavity, the fourth valve being configured to open at a fourth pressure level that is higher than the first pressure level, the second pressure level, and the third pressure level; and a compensation piston disposed in the main cavity, the compensation piston being movable relative to the sealing unit in response to an increase in pressure, wherein when the pressure exceeds the first pressure level, the second pressure level, the third pressure level, and the fourth pressure level, the first valve, the second valve, the third valve, and the fourth valve open sequentially so as to distribute pressure across the first sealing element, the second sealing element, the third sealing element, and the fourth sealing element sequentially.

26. The sealing assembly of claim 25, further comprising a first carrier configured to hold the first sealing element, a second carrier configured to hold the second sealing element, a third carrier to hold the third sealing element, and a fourth carrier to hold the fourth sealing element.

27. The sealing assembly of claim 25, wherein the compensation piston is configured to move toward or away from the sealing unit in response to pressure applied to the compensation piston.

28. The sealing assembly of claim 25, further comprising:

a first input passageway extending from the first valve to the main cavity, and a first output passageway extending from the first valve to a location between the first sealing element and the second sealing element, wherein pressure is distributed across the first sealing element through the first output passageway to a location uphole from the first sealing element.

29. The sealing assembly of claim 25, further comprising:

a second input passageway extending from the second valve to the main cavity, and a second output passageway extending from the second valve to a location between the second sealing element and the first end of the housing, wherein pressure is distributed across the second sealing element through the second output passageway to a location uphole from the second sealing element.

30. The sealing assembly of claim 25, further comprising:

a third input passageway extending from the third valve to the main cavity, and a third output passageway extending from the third valve to a location between the third sealing element and the first end of the housing, wherein pressure is distributed across the third sealing element through the third output passageway to a location uphole from the third sealing element.

31. The sealing assembly of claim 25, further comprising:

a fourth input passageway extending from the fourth valve to the main cavity, and a fourth output passageway extending from the fourth valve to a location between the fourth sealing element and the first end of the housing, wherein pressure is distributed across the fourth sealing element through the fourth output passageway to a location uphole from the fourth sealing element.

* * * * *